US008870011B2

(12) United States Patent
Hammer et al.

(10) Patent No.: US 8,870,011 B2
(45) Date of Patent: Oct. 28, 2014

(54) REFILLABLE CONTAINER SYSTEM AND METHOD FOR ASSEMBLY

(75) Inventors: Karen Hammer, Munich (DE); Dominic Bakic, Munich (DE)

(73) Assignee: DB Design GmbH, Munich (DE)

( * ) Notice: Subject to any disclaimer, the term of this patent is extended or adjusted under 35 U.S.C. 154(b) by 0 days.

(21) Appl. No.: 13/481,202

(22) Filed: May 25, 2012

(65) Prior Publication Data

US 2013/0105476 A1 May 2, 2013

(30) Foreign Application Priority Data

May 25, 2011 (EP) ..... 11167483

(51) Int. Cl.

| | |
|---|---|
| ***A45D 33/22*** | (2006.01) |
| ***A45D 33/24*** | (2006.01) |
| ***B65D 21/02*** | (2006.01) |
| ***A45D 40/00*** | (2006.01) |
| ***A45D 33/18*** | (2006.01) |
| *A45D 34/00* | (2006.01) |

(52) U.S. Cl.

CPC ..... *B65D 21/0233* (2013.01); *A45D 2034/007* (2013.01); *A45D 40/0068* (2013.01); *A45D 2040/0012* (2013.01); *A45D 33/18* (2013.01)

USPC ..... 220/23.89; 220/23.87; 206/581

(58) Field of Classification Search

USPC ..... 220/737, 23.87, 783, 780, 23.91, 23.89, 220/23.83, 254.1, 254.7, 255, 256.1; 132/293, 300, 303; 206/823, 581

See application file for complete search history.

(56) References Cited

U.S. PATENT DOCUMENTS

| | | | | |
|---|---|---|---|---|
| 2,728,494 | A * | 12/1955 | Hobson | 222/386.5 |
| 5,938,016 | A * | 8/1999 | Erdtmann | 206/221 |
| 6,047,710 | A * | 4/2000 | Irving et al. | 132/293 |
| 6,129,089 | A * | 10/2000 | Yuhara | 132/300 |
| 6,293,286 | B1 | 9/2001 | Gueret | |
| 6,336,460 | B2 * | 1/2002 | Yuhara | 132/295 |
| 6,712,076 | B2 * | 3/2004 | Alexander et al. | 132/300 |
| 7,451,877 | B2 * | 11/2008 | Koga et al. | 206/581 |
| 7,832,564 | B2 * | 11/2010 | Kim | 206/581 |
| 2004/0211779 | A1 * | 10/2004 | Yuhara | 220/259.1 |
| 2006/0054517 | A1 * | 3/2006 | Albert | 206/233 |
| 2007/0029226 | A1 * | 2/2007 | Yuhara et al. | 206/581 |
| 2007/0215494 | A1 * | 9/2007 | Yuhara | 206/37 |
| 2008/0217208 | A1 * | 9/2008 | Mathiez | 206/581 |

FOREIGN PATENT DOCUMENTS

| | | | |
|---|---|---|---|
| DE | 866 084 | | 2/1953 |
| JP | 2000-139554 | | 5/2000 |
| JP | 2000189237 | A * | 7/2000 |
| JP | 2001292826 | A * | 10/2001 |
| JP | 2003-245123 | | 9/2003 |
| JP | 2003-265222 | | 9/2003 |

* cited by examiner

*Primary Examiner* — Fenn Mathew
*Assistant Examiner* — Robert Stodola
(74) *Attorney, Agent, or Firm* — Lowe Hauptman & Ham, LLP

(57) ABSTRACT

A refillable container system includes an outer container configured to receive an inner container from a first side, the inner container configured to be inserted into the outer container, and an outer cover configured to receive an inner cover from a first side for avoiding deterioration of the sealing properties caused by wear of a closure, soiling of the cover, and contaminating of a refilled content.

18 Claims, 15 Drawing Sheets

Detail 1

Detail 4

REFILLABLE CONTAINER SYSTEM AND METHOD FOR ASSEMBLY

CROSS REFERENCE TO RELATED APPLICATION

This application claims the priority of European Patent Application No. 11167483.4 field on May 25, 2011 in the EPO (European patent Office), the disclosure of which is incorporated herein in its entirety by reference.

BACKGROUND

The present invention relates to a refillable container system and to a method for assembly of this container system and in particular to a refillable container system in which, on the one hand, deterioration of the sealing properties caused by wear of the closure and, on the other hand, soiling of the cover and a resulting contamination of the refilled content with old and possibly already spoiled rests of the old content are avoided.

In the prior art, e.g. in the cosmetics sector, a refillable container system having the following characteristics is known: The content is contained in an inner container which is intended to be used only once and for which replacements can be bought. When being sold, the opening of the inner container is closed by means of a covering or sealing film which must be removed in order to get access to the content. Once removed, the covering film cannot be used for sealing the inner container again, it is thrown away. For refilling, the inner container is inserted into an outer container. This insertion is performed by introducing the inner container into a first opening of the outer container. The inner container is inserted into the outer container in such a manner that the opening of the inner container points to the same side as the first opening of the outer container. After having been successfully inserted, the inner container is held by a fixing mechanism, for example a press fit, at the side of this first opening in the outer container. Moreover, the outer container comprises a second opening at a side opposite that of the first opening, i.e., at the bottom of the container. Through this opening, the bottom of the inner container can thus be touched from outside. Therefore, the inner container can be removed from the outer container through the second opening, e.g., by simply pushing it with a finger. For closing the inner container inserted into the outer container, a cover is fixed to the outer container from the side of the first opening of the outer container, e.g. by screwing.

The refillable container system described above is disadvantageous in that when being used permanently, also the inner side of the cover comes in contact with the content, e.g. by shaking or tilting the container system when transporting it in a handbag, which leads to a steadily increasing soiling of the inner side of the cover. After refilling, i.e., after insertion of the new inner container, the new content is thus contaminated with the rests of old and possibly already spoiled content at the inner side of the cover, and thus the quality of the content is reduced.

SUMMARY

The invention described herein solves these problems in that not only the inner container is replaced during refilling but also an inner cover. Since the actual sealing, i.e., the contact of the content with the environmental air, is now realized by the closure between inner container and inner cover, this closure is replaced during each refilling process and thus wear is avoided. Moreover, the inner side of the new inner cover is of course not soiled with rests of older contents so that the new content is not contaminated with such rests either.

According to a first aspect, the invention relates to a container system comprising four components that can be assembled to form a container. The container system comprises an outer container, an inner container, an outer cover and an inner cover. The outer cover is adapted to receive an inner container from a first side and can be releasably connected with the inner container by means of a first fixing mechanism. Preferably, the inner container is received concentrically in the outer container. At a second side, which is opposite the first side (for example in the bottom of the container), the outer container comprises an opening into which a bottom section of the inner container can be inserted. The inner container can be inserted into the outer container and can be releasably connected with the outer container by means of the first fixing mechanism. According to the invention, the outer container and the inner container can be connected at the side opposite the insertion opening, i.e., preferably at the bottom or in the vicinity of the bottom of the outer container.

According to the invention, "connection" or "can be connected" does not only mean a mere contact between outer container and inner container but a fixing to such an extent that the containers are held on one another, with the fixing, however, being releasable. According to the invention, a "releasable connection" means that the fixing is not permanent in the meaning of irreversible but can be released or neutralized by applying a pressure or a force lying above a threshold value which depends on the kind of fixing.

The inner container has an opening which can be closed by means of an inner cover. The inner container can be releasably connected with the inner cover by means of a second fixing mechanism.

The outer cover can receive an inner cover from a first side and can be releasably connected with the inner cover by means of a third fixing mechanism. At a second side which is opposite the first side, the outer cover comprises an opening into which a projecting section of the inner cover can be inserted. Moreover, the outer cover can be releasably connected with the outer container by means of a fourth fixing mechanism.

According to an embodiment of the container system, the first fixing mechanism is realized by a press fit or a first snap-in connection. This means that the inner container can be snap-fitted to the outer container at the bottom of the outer container or can be engaged therewith by means of a press fit. The first snap-in connection is preferably realized such that an edge formed by the rim of an opening in the outer container can lock with an at least partially circumferential groove at the bottom side of the inner container. The bottom side of the inner container is opposite the opening side of the inner container. Moreover, the groove is preferably realized such that the bottom section of the inner container projects like a plateau from the bottom side of the inner container and an at least partially circumferential projection is formed such at the bottom section that an at least partially circumferential groove is formed between the projection and the area of the wall of the inner container directly adjoining the bottom section. When viewed in the transverse direction of the inner container, the plateau-like bottom section has smaller dimensions than the remaining inner container. For example, in case the inner container is cylindrical, the diameter of the plateau is smaller than the diameter of the inner container itself.

The term "circumferential" used above in connection with a groove, a projection, etc. means here and in the following that the groove, the projection, etc. encloses a body along a closed curve, wherein the groove, the projection, etc. is firmly connected with the body. "Partially circumferential" means here and in the following accordingly that a groove, a projection, etc. does not have to extend along an entire closed curve but is realized only at one or more sections of this curve. These sections can be realized, e.g., as segments of a circle or straight lines but they can also be reduced to a point, so that in the latter case at least a part of the groove or a part of the projection is realized by a punctiform recess or a knob.

According to an embodiment of the container system, at least one projection is provided at the outer side or outer wall of the (substantially cylindrical or rotationally symmetrical) inner container for protection against rotation or as a twist-lock. When inserting the inner container into the outer container, this projection must be inserted into a corresponding groove in the inner side of the outer container. Alternatively, it is also possible that the inner wall of the outer container has a projection for protection against rotation, said projection engaging with a corresponding recess in the outer wall of the inner container.

In accordance with a preferred embodiment of the container system of the invention, the fourth fixing mechanism is realized by a screw connection. This means that the outer cover and the outer container can be screwed together.

According to an embodiment of the container system, the third fixing mechanism is realized by a second press fit or a second snap-in connection. This means that the inner cover can be engaged with the outer cover, for example at the "bottom" of the outer cover, by means of a snap-in connection or a press fit. The first snap-in connection is realized such that the edge of the opening of the outer cover comprises inwardly extending projections, i.e., projections being directed to the central axis of the outer cover, for example an at least partially circumferential edge, projecting knobs or segments, which can lock with an at least partially circumferential groove at the upper side of the inner cover. The "upper side" of the inner cover is opposite the side of the inner cover which is opposite the opening of the inner container when the inner container is closed by means of the inner cover. Moreover, the groove is preferably realized such that the section of the inner cover projects like a plateau from the upper side of the inner cover and an at least partially circumferential projection is formed at the section so that an at least partially circumferential recess is formed between the projection and the area of the upper side of the inner cover directly adjoining the section. When viewed in the transverse direction of the inner cover, the plateau-like bottom section has smaller dimensions than the remaining inner cover. For example, in case the inner cover is substantially circular, the diameter of the plateau is smaller than the diameter of the inner cover.

According to an embodiment of the container system, an at least partially circumferential recess is provided in the outer cover around the opening formed in the outer cover so that the inner wall of the opening formed in the outer cover can retreat elastically when the inner cover locks. For example, this recess is formed as a slot extending concentrically with respect to the opening and around the opening in the axial direction, i.e., parallel with respect to the central axis of the opening or the cover.

According to an embodiment of the container system, the second fixing mechanism is realized by a third snap-in connection. The latter is realized such that the inner cover can be snap-fitted to the inner container and the outer side of the opening of the inner container comprises one or more projections, for example, an at least partially circumferential edge or flange, projecting knobs or segments. A plurality of grooves or a circumferential groove is/are formed in this/these projection(s). Depending on the geometry of the projections, these grooves in turn can be realized, e.g., as an at least partially circumferential groove or as punctiform or segment-shaped recesses. The inner side of the inner cover comprises projections or a closed circumferential projection, which in turn is/are adapted to the geometry of the grooves, i.e., is/are realized as at least partially circumferential edge, projecting knobs or segments, so that the projections of the inner cover can lock with the grooves of the inner container.

According to a second aspect, the invention relates to a container system comprising four components which are assembled to form a container. The container system comprises an outer container, an inner container, an outer cover and an inner cover. The inner container is inserted into the outer container from a first side. At a second side, which is opposite the first side (for example in the bottom of the container), the outer container comprises an opening into which a bottom section of the inner container is inserted. The outer container is releasably connected with the inner container by means of a first fixing mechanism. Preferably, the inner container is received concentrically in the outer container. According to the invention, the outer container and the inner container are releasably connected at the side opposite the insert opening, i.e., preferably at the bottom or in the vicinity of the bottom of the outer container. Moreover, the inner container is releasably connected with the inner cover by means of the second fixing mechanism. From a third side, the inner cover is inserted into the outer cover. At the fourth side, which is opposite the third side, the outer cover comprises an opening into which a section of the inner cover is inserted. The outer cover is releasably connected with the inner cover by means of a third fixing mechanism and releasably connected with the outer container by means of a fourth fixing mechanism.

According to an embodiment of the container system, the first fixing mechanism is realized by a first press fit or a first snap-in connection. This means that the inner container is snap-fitted to the outer container at the bottom of the outer container or engaged therewith by means of a press fit. The first snap-in connection is preferably realized such that an edge formed by the rim of the opening in the outer container is locked with an at least partially circumferential groove at the side of the inner container which is opposite the opening of the inner container. Moreover, the groove is realized by a circumferential projection formed at the lower side of the inner container. Preferably, a bottom section of the inner container projects like a plateau from the bottom side of the inner container, wherein an at least partially circumferential projection is formed such at the bottom section that an at least partially circumferential recess is formed between the projection and the area of the wall of the inner container directly adjoining the bottom section. When viewed in the transverse direction of the inner container, the plateau-like bottom section has smaller dimensions than the remaining inner container. For example, in case the inner container is cylindrical, the diameter of the plateau is smaller than the diameter of the inner container itself.

According to an embodiment of the container system, the outer side of the inner container comprises at least one projection for protection against rotation, said projection being located in a corresponding recess in the inner side of the outer container.

According to an embodiment of the container system of the invention, the fourth fixing mechanism is realized by a screw connection. This means that the outer cover and the outer container can be screwed together.

According to an embodiment of the container system, the third fixing mechanism is realized by a second press fit or a second snap-in connection. This means that the inner cover is engaged with the outer cover, for example at the "bottom" of the outer cover, by means of a snap-in connection or a press fit. The second snap-in connection is realized such that the edge of the opening in the outer cover comprises inwardly extending projections, i.e., projections being directed to the central axis of the outer cover, for example an at least partially circumferential edge, projecting knobs or segments, which are locked with an at least partially circumferential groove at the inner cover, and the groove is realized by at least one circumferential projection formed at the inner cover. The groove is preferably formed at the "upper side" of the inner cover. The "upper side" of the inner cover is opposite the side of the inner cover which is opposite the opening of the inner container when the inner container is closed by means of the inner cover. Moreover, the groove is preferably realized such that the section of the inner cover projects like a plateau from the upper side of the inner cover and an at least partially circumferential projection is formed such at the section that an at least partially circumferential recess is formed between the projection and the area of the upper side of the inner cover directly adjoining the section. When viewed in the transverse direction of the inner cover, the plateau-like section has smaller dimensions than the remaining inner cover. For example, in case the inner cover is substantially circular, the diameter of the plateau is smaller than the diameter of the inner cover. Preferably, a recess is formed in the outer cover around the opening in the outer cover so that the rim of the opening in the outer cover can retreat elastically when the inner cover locks.

According to an embodiment of the container system, the second fixing mechanism is realized by a third snap-in mechanism. This snap-in mechanism is realized as follows:

The inner cover is put on the inner container, and the opening side of the inner container comprises an at least partially circumferential, outwardly-directed projection, for example an at least partially circumferential edge or flange, projecting knobs or segments. This/these projection(s) in turn comprise(s) a groove or a plurality of grooves. Depending on the geometry of the projections, these grooves can be realized, e.g., as at least partially circumferential groove or as punctiform or segment-shaped recesses. Projections, for example a closed circumferential projection or an at least partially circumferential edge, projecting knobs or segments, which are formed at the inner side of the inner cover, are locked with these grooves.

According to a preferred embodiment of the container system, the third fixing mechanism provides for a stronger connection than the second fixing mechanism. Moreover, the first fixing mechanism provides for a stronger connection than the second fixing mechanism. Thus, the components can be assembled in a particularly simple, easily manageable and user-friendly manner, as will be shown in more detail in the following in connection with the method according to the invention.

According to an embodiment of the container system, the outer container is rotationally symmetrical except for features possibly caused by fixing mechanisms, and/or the inner container is rotationally symmetrical except for features possibly caused by fixing mechanisms, and/or the outer cover is rotationally symmetrical except for features possibly caused by fixing mechanisms, and/or the inner cover is rotationally symmetrical except for features possibly caused by fixing mechanisms. It is clear that any other geometries of the individual components are possible, e.g. geometries having square cross-sections. The only restriction for these geometries is the fact that the components must be designed and adapted to each other such that they can be connected with each other in the manner described in the above paragraphs.

The invention furthermore relates to an inner container and an inner cover or an inner container with inner cover. The inner container comprises a first fixing mechanism for releasably connecting the inner container with the outer container when the inner container has been inserted into a suitably shaped outer container. Moreover, the inner container comprises an opening that can be closed by means of the inner cover. At the side of the opening, the inner container can be releasably connected with the inner cover by means of a second fixing mechanism. Furthermore, the inner cover comprises a third fixing mechanism for releasably connecting the inner cover with the outer cover when the inner cover has been inserted into a suitably shaped outer cover. The inner cover is designed such that the opening of the inner container can be closed by means of a first side of the inner cover.

According to an embodiment of the inner container and the inner cover, the first fixing mechanism is realized by a first press fit or a first snap-in connection. The first snap-in connection is realized such that projections, for example a partially circumferential edge, projecting knobs or segments, of a suitably shaped outer container can be locked with an at least partially circumferential groove at the side of the inner container opposite the opening of the inner container. Moreover, the groove is realized by an at least partially circumferential projection provided at the side of the inner container which is opposite the opening of the inner container.

According to an embodiment of the inner container and the inner cover, the third fixing mechanism is realized by a second press fit or a second snap-in connection. The second snap-in connection is realized such that projections, for example a partially circumferential edge, projecting knobs or segments, of a suitably shaped outer cover can be locked with an at least partially circumferential groove at the opening side of the inner cover. Moreover, the groove is realized by an at least partially circumferential projection provided at the opening side of the inner cover.

According to an embodiment of the inner container and the inner cover, the second fixing mechanism is realized by a third snap-in connection which is realized such that the inner cover is put on the inner container and a partially circumferential projection provided at the outer side of the opening side of the inner container comprises an at least partially circumferential groove which can lock with projections, for example an at least partially circumferential edge, projecting knobs or segments, provided at the inner side of the inner cover.

According to an embodiment of the inner container and the inner cover, the inner container is rotationally symmetrical except for features possibly caused by fixing mechanisms, and/or the inner cover is rotationally symmetrical except for features possibly caused by fixing mechanisms. It is clear that any other geometries of the inner container and the inner cover are possible, e.g. geometries having square cross-sections. The only restriction for these geometries is the fact that the inner container and the inner cover must be designed and adapted to each other such that they can be connected with each other in the manner described in the above paragraphs.

According to an embodiment of the inner container and the inner cover, at least one projection is provided at the outer side of the inner container for protection against rotation, wherein said projection must be inserted into a corresponding recess at the inner side of the outer container when inserting the inner container into the outer container.

According to an embodiment of the inner container and the inner cover, the inner container comprises a first disk at its side opposite its opening. At its lower side, the disk has a circumferential projection which forms a circumferential groove. Moreover, at a second side, which is opposite the first side of the inner cover, the inner cover comprises a second disk, wherein the second disk has a partially circumferential projection which forms an at least partially circumferential groove.

According to an embodiment of the inner container and the inner cover, the first disk has—with respect to the direction in which the inner cover is put on the inner container—a concave curvature and/or the second disk has a convex curvature.

According to an embodiment of the inner container and the inner cover, the inner cover comprises an outer cap and an inner insert. The inner insert can be inserted into the outer cap. Moreover, the outer cap and the inner insert are connected with each other by means of a fifth fixing mechanism, preferably a snap-in connection.

According to an embodiment of the inner container and the inner cover, the inner container and the inner cover are releasably connected with each other, wherein a tamper-proof seal is provided around the projection provided at the outer side of the opening side of the inner container on the one hand and at the inner cover along the circumference on the other hand, said tamper-proof seal providing a further connection between the inner container and the inner cover so that the inner container can be disconnected from the inner cover only after the tamper-proof seal has been destroyed.

The invention further relates to a method for assembling a container, preferably the container system described above. This method comprises the following steps: (i) inserting an inner container that is releasably connected with an inner cover into an outer container, (ii) closing the outer container by means of an outer cover, wherein closing causes a pressure to be exerted on the inner container and the inner cover so that the inner container is fixed in the outer container by means of a first fixing mechanism and the inner cover is fixed in the outer cover by means of a third fixing mechanism.

In step (i), in which the inner container is inserted into the outer container, the two containers are preferably not yet fixed to each other. Rather, the inner container is inserted only so far until it reaches the fixing mechanism. Only when the outer cover is put on the inner cover, wherein the inner cover is inserted into the outer cover and the outer cover is connected with the outer container, is—during this connection procedure—the inner container automatically fixed to the outer container by means of the first fixing mechanism and the inner cover is fixed to the outer cover by means of the third fixing mechanism. During this entire procedure, the inner cover is still placed on the inner container and connected therewith.

According to an embodiment of this method, the outer container is closed by means of the outer cover by screwing.

According to an embodiment of this method, the first fixing mechanism and the third fixing mechanism are realized such that (only) when the assembled container is unscrewed, the inner cover is released from the inner container, but the inner container remains connected with the outer container and the inner cover remains connected with the outer cover. In accordance with the invention, this is realized in that the third fixing mechanism provides for a stronger connection than the second fixing mechanism and also the first fixing mechanism provides for a stronger connection than the second fixing mechanism.

The container system according to the invention is preferably suitable for storing flowable or viscous substances, such as cosmetics, e.g. creams. However, the invention also comprises the storage or receipt of other flowable substances such as adhesives, coloring substances or the like. The invention further comprises the storage of highly viscous, non-flowable substances such as gel or wax, or also the storage of substances or objects in powder and/or particle form, e.g. powder, tablets or the like.

BRIEF DESCRIPTION OF DRAWINGS

In the following, the invention will be described on the basis of examples and the drawings in which.

DETAILED DESCRIPTION

Figure 1:
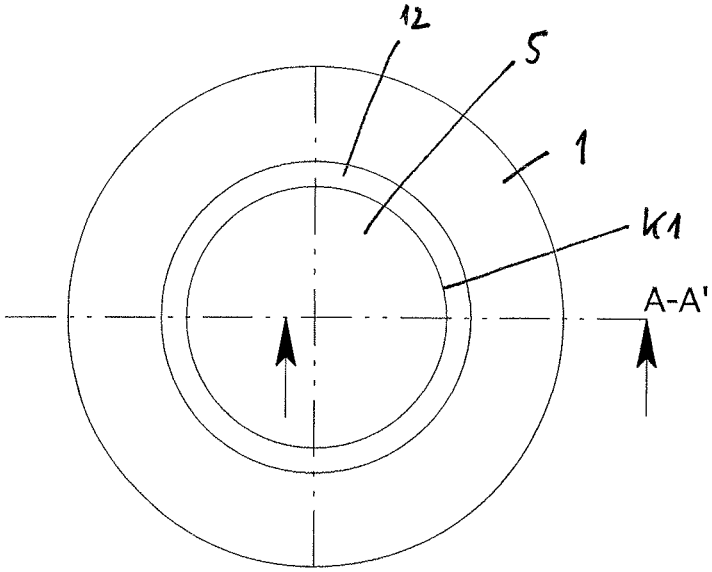
FIG. 1 shows a top view of the bottom side of the outer container.

FIG. 1 shows the outer container 1 viewed from the bottom side. The container bottom comprises an opening 5 whose rim is formed by a chamfer 12. In particular, the chamfer 12 tapers in the direction of the opening 5 so that a circumferential edge K1 is formed.

Figure 2:
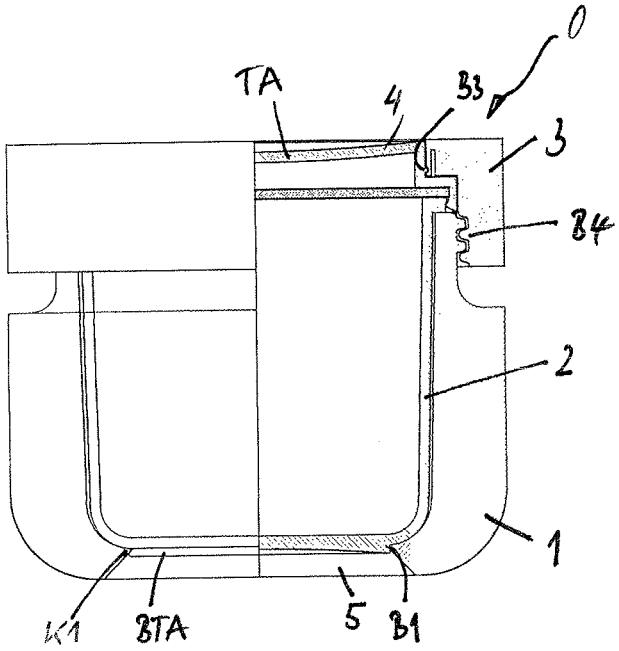
FIG. 2 shows a partial section through the container system in the assembled state.

FIG. 2 shows a partial section according to A-A' of FIG. 1 through the container system 0 in the assembled state. The outer cover 3 is releasably connected with the outer container 1 by means of a fixing mechanism B4, here a screw connection. The inner cover 4 is also releasably connected with the inner container 2. Moreover, the inner cover 4 is inserted into the outer cover 3 and releasably connected therewith by means of the fixing mechanism B3. Analogously, the inner container 2 is inserted into the outer container 1 and releasably connected therewith by means of the fixing mechanism B1. The plateau-like bottom section BTA provided at the bottom side of the inner container 2 is located in the opening 5 which is provided at the bottom side of the outer container 1 and limited by the edge K1. In this preferred embodiment, the bottom section BTA is snap-fitted to the bottom of the outer container 1 by means of the edge K1. Furthermore, a section TA of the inner cover provided like a plateau at the inner cover 4 is located in the opening 6 (see FIG. 3) of the outer cover 3. In the shown preferred embodiment, also the section TA is connected with the outer cover 3 by means of a snap-in connection.

Figure 3:
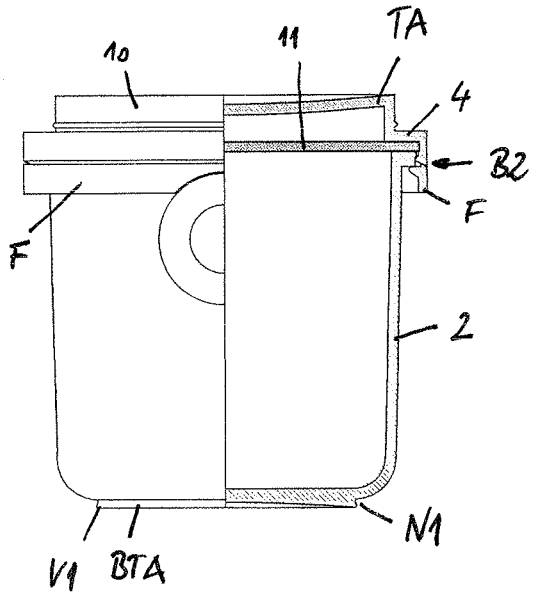
FIG. 3 shows the inner container and inner cover in the releasably connected state.

FIG. 3 shows the inner container 2 and the inner cover 4 in a releasably connected state. The connection is realized by the fixing mechanism B2. The inner cover 4 comprises an inner insert 11 which is inserted into a cap 10. The bottom side of the inner container 2 comprises the bottom section BTA projecting like a plateau. The bottom section BTA comprises an at least partially circumferential projection V1. Between the projection V1 and the area of the wall of the inner container which directly adjoins the bottom section BTA, an at least partially circumferential groove N1 is thus realized. A tamper-proof seal F is provided at the cap 10 of the inner cover 4. Said tamper-proof seal F encloses a projection which is arranged at the opening side of the inner container 2 and directed outwardly and which realizes the fixing mechanism B2. The tamper-proof seal F thus realizes an additional connection between the inner cover 4 and the inner container 2.

Figure 4:
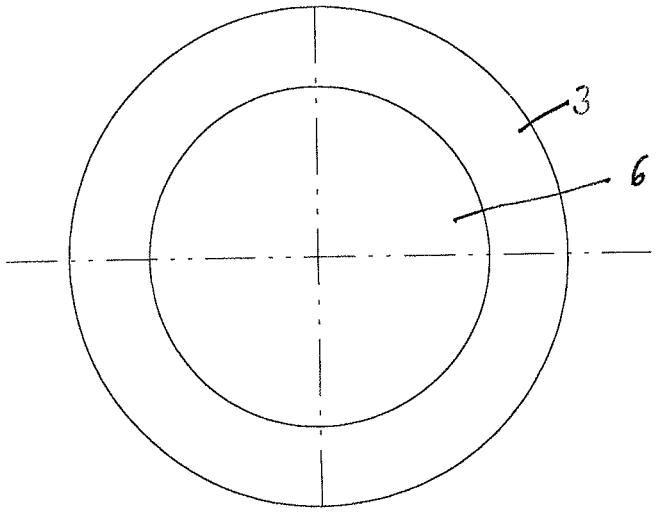
FIG. 4 shows a top view of the outer cover.
Figure 5:
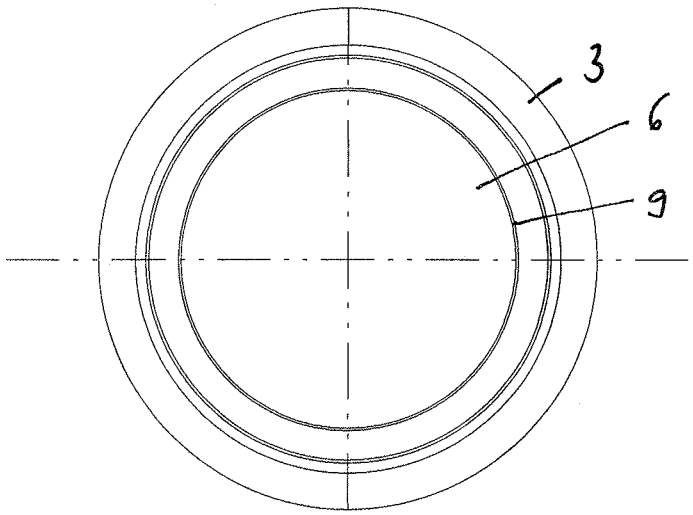
FIG. 5 shows a top view of the (lower) side of the outer cover.

A top view of the outer cover 3 is shown in FIG. 4. The outer cover 3 comprises an opening 6. FIG. 5 shows a top view of the (lower) side of the outer cover 3 from which the inner cover 4 is inserted into the outer cover 3. Around the opening 6 provided in the outer cover 3, a recess 9 is formed in the outer cover 3 so that the rim of the opening 6 in the outer cover 3 can retreat elastically.

Figure 6:
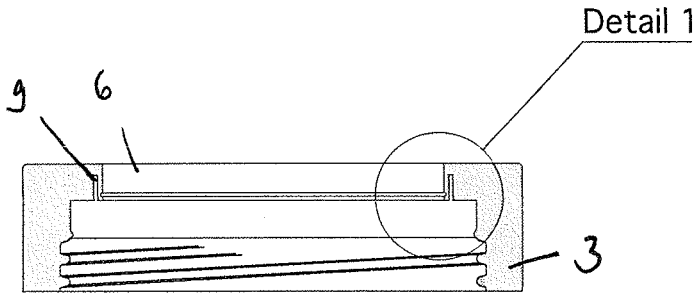
FIG. 6 shows a section through the outer cover.
Figure 7:
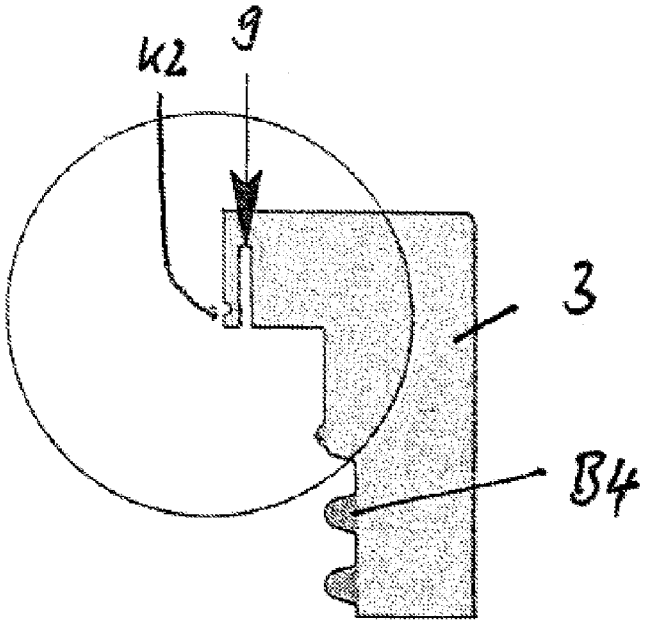
FIG. 7 shows a sectional view of the outer cover (detail)

FIG. 6 shows a section through the outer cover 3. Behind the rim of the outer cover 3 limiting the opening 6 in the outer cover 3, a recess is formed in the outer cover 3 so that the rim can retreat elastically. FIG. 7 shows a detail of the sectional view of the outer cover 3 of FIG. 6. The fixing mechanism B4, which allows fixation to the outer container 1, is here realized by a screw connection. An at least partially circumferential edge K2, which is directed inwardly, i.e., towards the central axis of the outer cover, is provided at the rim of the opening 6 in the outer cover 3. The recess 9, which allows an elastic retraction of this rim, is provided behind this rim.

Figure 8:
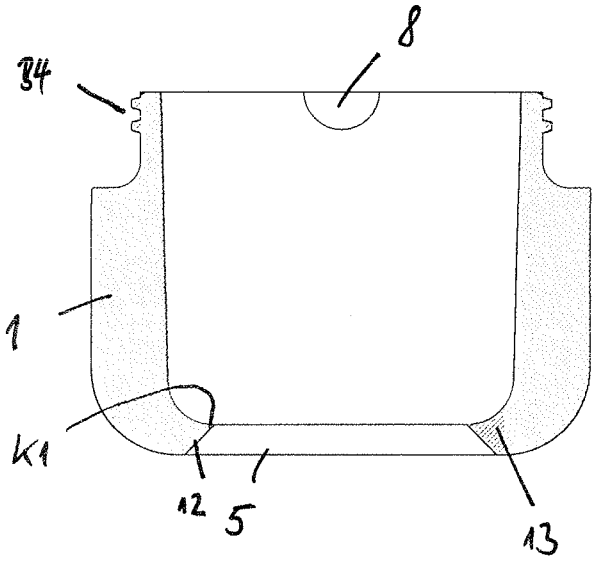
FIG. 8 shows a section through the outer container.

FIG. 8 shows a section through the outer container 1. The bottom side of the wall of the outer container 1 comprises a container wall section 13 which is bent towards the central axis of the outer container 1. Moreover, the bottom side of the outer container 1 comprises an opening 5 being limited by the chamfer 12, wherein in turn the chamber 12 forms the rim of the container wall section 13. Moreover, the chamfer 12 tapers in the inward direction and thus forms an edge K1. The side of the outer container 1 from which the inner container 2 can be inserted comprises the fixing mechanism B4, which is here realized by a screw connection. The Figure moreover shows a recess 8 in the wall of the outer container 1, wherein the recess 8 serves for protection against rotation of the inner container 2—as soon as it has been inserted—relative to the outer container 1.

Figure 9:
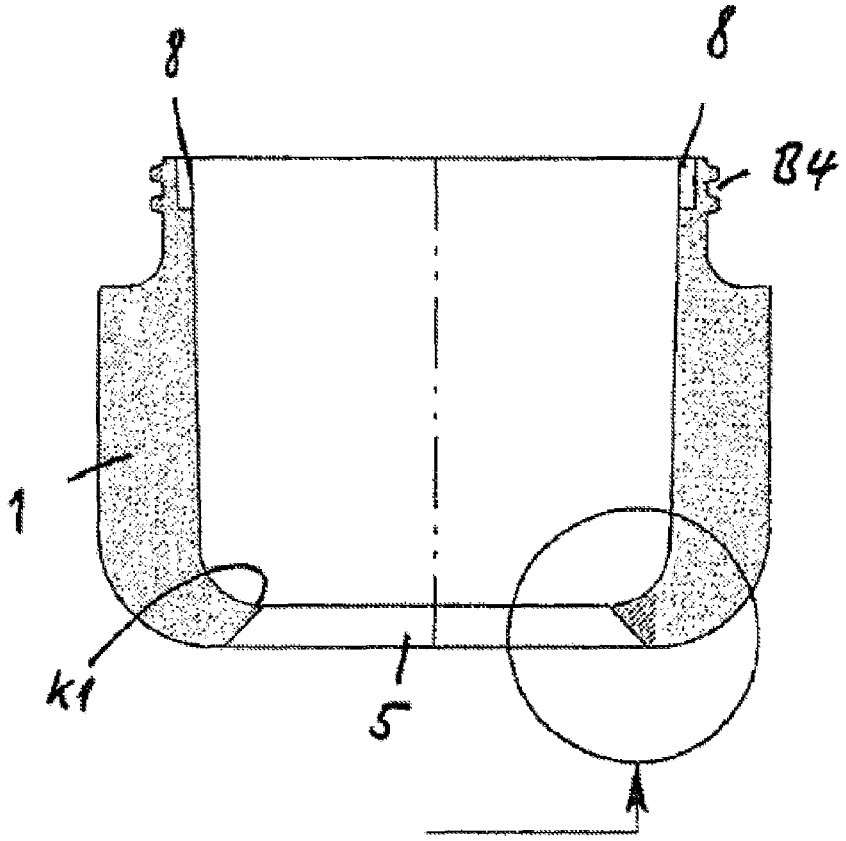
FIG. 9 shows a section through the outer container.

FIG. 9 shows, like FIG. 8, a further section through the outer container 1. However, in this case the section is selected such that it extends through two opposite recesses 8 which are provided at the inner wall of the outer container 1 at the side from which the inner container 2 can be inserted into the outer container 1.

Figure 10:
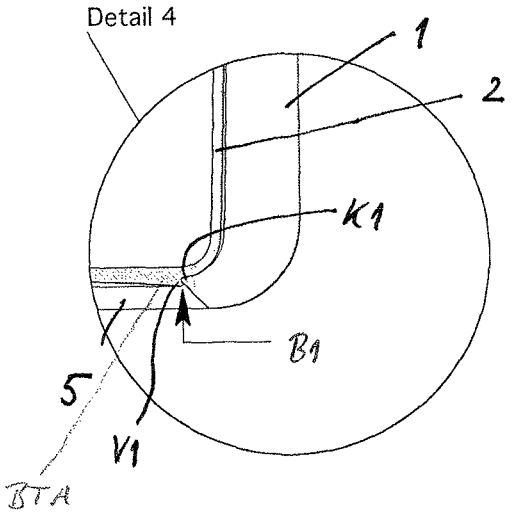
FIG. 10 shows an illustration of the fixing mechanism between inner container and outer container.

FIG. 10 illustrates in detail the fixing mechanism B1 by means of which the outer container 1 is releasably connected with the inner container 2. A bottom section BTA of the inner container 2 is inserted into an opening 5 of the outer container 1. The rim of the outer container 1, which is directed towards the opening 5, is formed by an at least partially circumferential edge K1. The edge K1 is locked with a groove at the inner container 2, which is formed by a projection V1 at the bottom section BTA of the inner container 2 and the area of the wall of the inner container 2 which directly adjoins the bottom section BTA.

Figure 11:
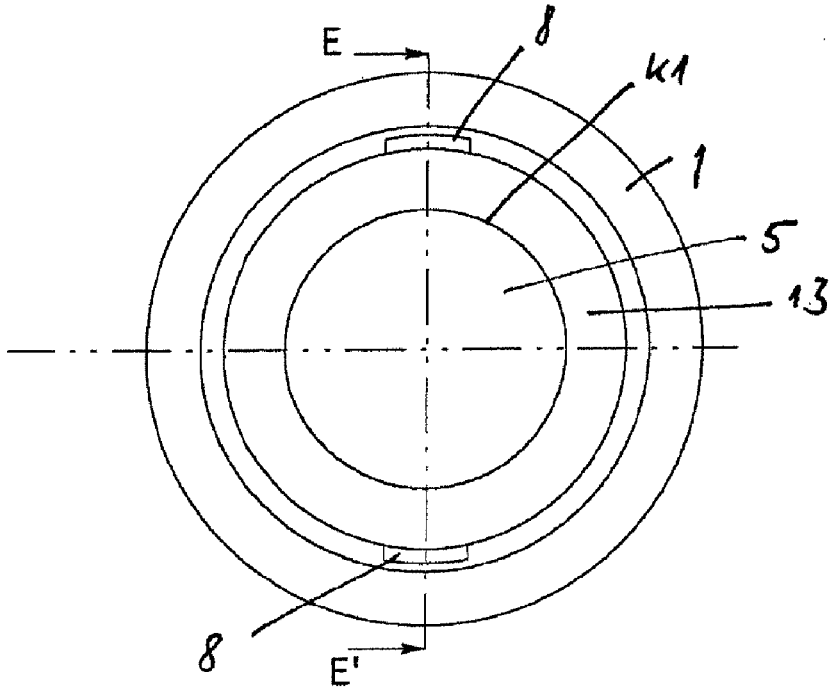
FIG. 11 shows a top view of the (upper) side of the outer container.

FIG. 11 shows a top view of the (upper) side of the outer container 1 from which the inner container 2 can be inserted in the outer container 1. The area around the central axis shows the opening 5 at the bottom side of the outer container 1. The opening 5 is limited by the chamfer 13 which tapers towards the opening 5 and thus forms the edge K1. Moreover, the inner wall of the outer container 1 preferably comprises recesses 8 which serve for the above-mentioned protection against rotation when the inner container 2 is inserted into the outer container 1.

Figure 12:
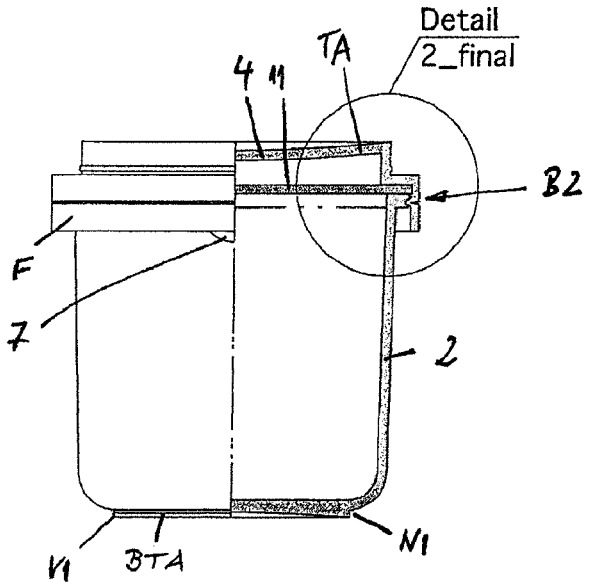
FIG. 12 shows a partial section through the inner container.

FIG. 12 shows on the left-hand side a side view and on the right-hand side a section through the inner container 2 and the inner cover 4 in the releasably connected state (i.e. in the delivery state before the inner container 2 is opened for the first time). At its bottom side, the inner container 2 comprises a bottom section BTA. This bottom section BTA comprises an at least partially circumferential projection V1. A partially circumferential groove N1 is thus formed between this projection V1 and the area of the wall of the inner container which directly adjoins the bottom section BTA. The inner cover 4 comprises an inner insert 11 which is inserted in and locked with a section TA of the inner cover. The inner cover 4 and the inner container 2 are releasably connected with each other by means of a fixing mechanism B2, which will be described in more detail in the following FIGS. 13 and 14. The section TA of the inner cover 4 comprises a tamper-proof seal F representing a further connection between the inner cover 4 and the inner container 2. Because of this additional connection, the connection between the inner cover 4 and the inner container 2 can be realized more weakly. Therefore, as will be described in the following, the fixing mechanism B2 is weaker than the mechanisms B1 and B3. Moreover, the outer wall of the inner container 2 comprises a projection 7 which serves for protection against rotation when the inner container 2 is inserted into the outer container 1 and engages with the recess(es) 8.

Figure 13:
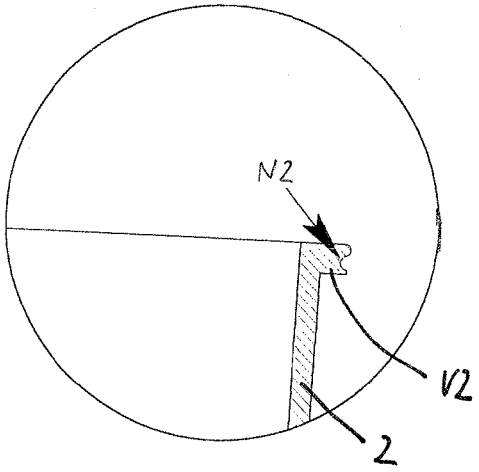
FIG. 13 shows a section through a wall section of the inner cover.

FIG. 13 shows a section through the wall section of the inner container 2 which limits the opening of the inner container 2. The end of the wall of the inner container 2 comprises an outwardly-directed, at least partially circumferential projection V2, which in turn comprises an at least partially circumferential groove N2.

Figure 14:
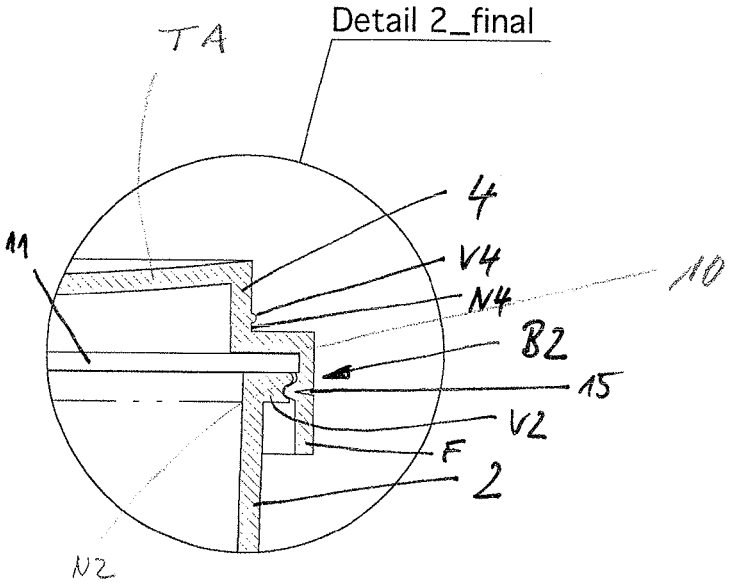
FIG. 14 shows an illustration of the fixing mechanism between inner cover and inner container.

FIG. 14 illustrates the fixing mechanism B2 between the inner cover 4 and the inner container 2. The inner cover 4 comprises an inner insert 11 and a cap 10. The inner insert 11 is inserted in and locked with the cap 10. Moreover, the cap 10 comprises a section TA projecting like a plateau. The section TA in turn comprises an at least partially circumferential projection V4. A groove N4 is provided between the projection V4 and the area of the cap 10 which directly adjoins the section TA. The cap 10 further comprises a tamper-proof seal F, which is offset from the rest of the cap by means of a weakening 15. The weakening 15 is provided at the outer side of the cap. The tamper-proof seal F can be separated irreversibly from the cap 10 by tearing it off, wherein the separation is realized along the weakening 15. Opposite the weakening 15, the inner side of the cap 10 comprises an inwardly-directed projection. This projection is locked with the groove N2 of the inner container 2 when the inner cover and the inner container are in the connected state. The groove N2 is then located in the outwardly-directed projection V2 which extends at least around part of the opening of the inner container 2.

Figure 15:
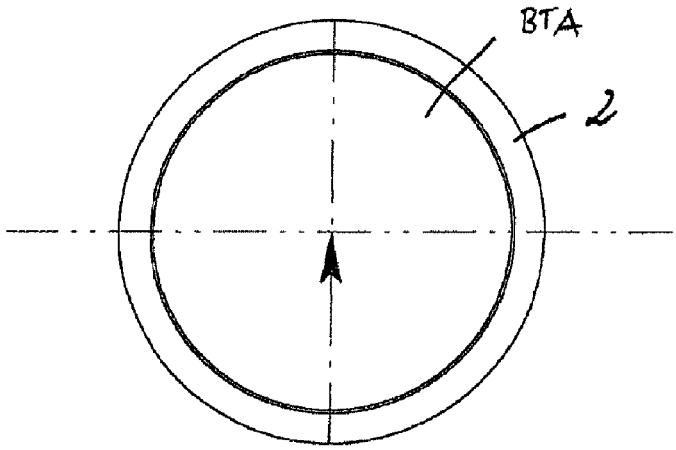
FIG. 15 shows a top view of the inner container from the bottom side.

FIG. 15 shows the inner container 2 from the bottom side. The bottom section BTA projects like a plateau from the bottom side of the inner container 2 in the direction of the viewer.

Figure 16:
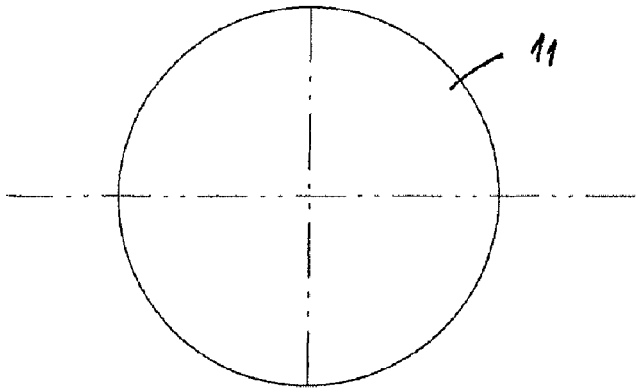
FIG. 16 shows an inner insert of the inner cover in top view.

FIG. 16 shows the inner insert 11 of the inner cover 4 in a top view.

Figure 17:
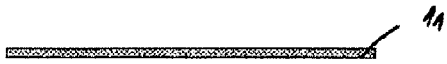
FIG. 17 shows an inner insert of the inner cover as a side view.

FIG. 17 shows a side view of the inner insert 11 of the inner cover 4.

Figure 18:
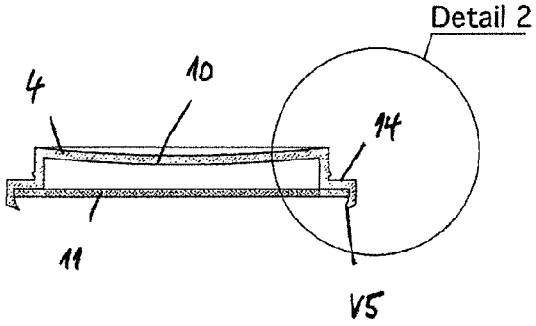
FIG. 18 shows a section through the inner cover.

FIG. 18 shows a section through the inner cover 4. An inner insert 11 is inserted or snapped in a cap 10. A side of the inner layer 11 is covered completely by the upper side 14 of the inner cover. Projections or an at least partially circumferential projection V5 is/are provided at the inner side of the inner cover 4.

Figure 19:
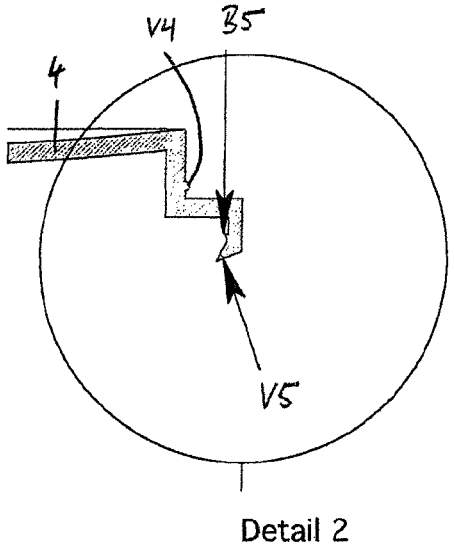
FIG. 19 shows a detail of FIG. 18.

The right-hand part of FIG. 18 is shown in enlarged form in FIG. 19. The inner cover 4 comprises a snap-in connection B5 into which the inner insert 11 can snap. Moreover, the inner cover 4 comprises an inwardly-directed projection V5 and an outwardly-directed projection V4. By means of the projection V4, the inner cover 4 is snapped in the outer cover 3. By means of the projection V5, the inner cover 4 is snapped on the inner container 2.

Figure 20:
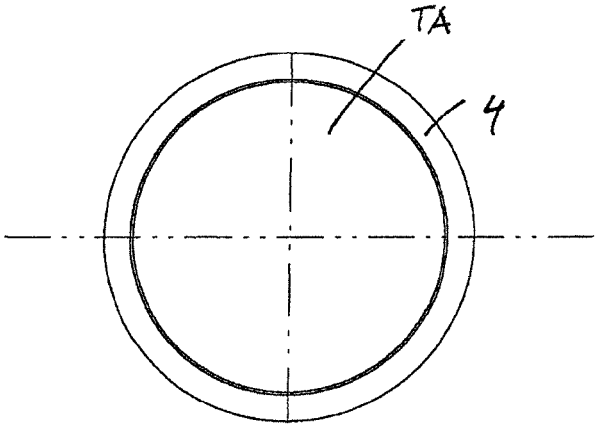
FIG. 20 shows a top view of the inner cover.

FIG. 20 shows a top view of the inner cover 4. The section TA projects like a plateau from the inner cover 4 in the direction of the viewer.

Figure 21:
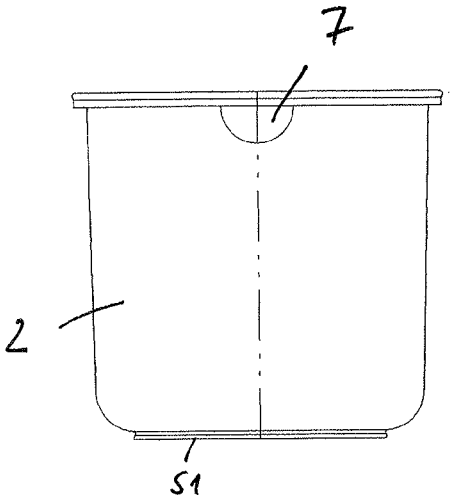
FIG. 21 shows a side view of the inner container.

FIG. 21 shows a side view of the inner container 2. At its bottom side, the inner container 2 comprises a disk S1 projecting like a plateau. At the side opposite the bottom side of the inner container 2, the outer side of the wall of the inner container 2 comprises the outwardly-directed projection 7 for protection against rotation.

Figure 22:
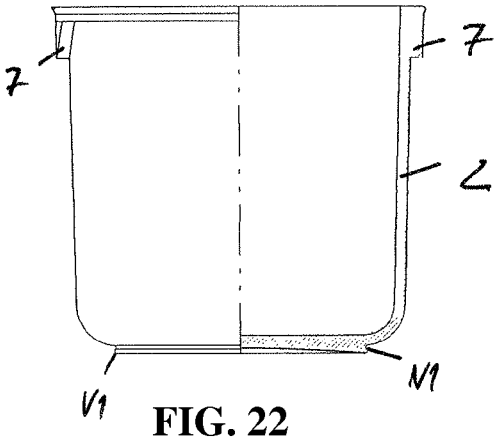
FIG. 22 shows a partial section through the inner container.

FIG. 22 shows on the left-hand side a side view and on the right-hand side a section through the inner container 2. The plateau-like disk S1, which has already been described in FIG. 21, comprises an at least partially circumferential projection V1. This projection V1 and the area of the wall of the inner container 2 directly adjoining the disk S1 form an at least partially circumferential groove N1. At the side opposite the bottom side, the outer side of the wall of the inner container 2 comprises outwardly-directed projections 7.

Figure 23:
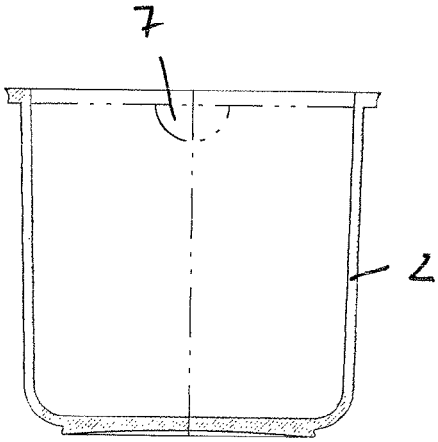
FIG. 23 shows a section through the inner container.

FIG. 23 shows a section through the inner container 2. A projection 7 is shown in dash-dotted lines, wherein the projection 7 is provided at the outer side of the wall of the inner container 2 at the side of the inner container 2 which faces away from the viewer.

Figure 24:
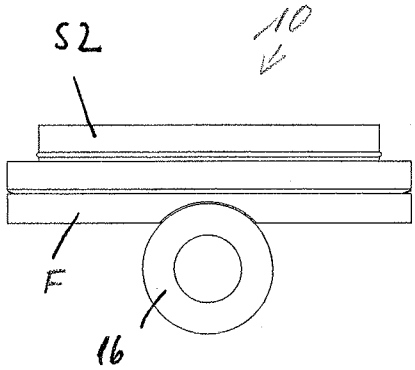
FIG. 24 shows a side view of the cap of the inner cover.

FIG. 24 shows a side view of the cap 10 of the inner cover 4. A disk S2 projects like a plateau from the cap 10. Moreover, the cap 10 comprises a tamper-proof seal F, wherein the tamper-proof seal F has a pulling part 16.

Figure 25:
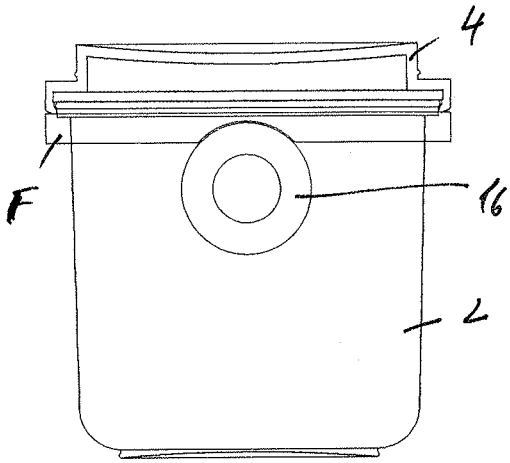
FIG. 25 shows a section and side view of the inner container and the inner cover in the connected state.

FIG. 25 shows a combination of a section and a side view of the inner container 2 and the inner cover 4 in the assembled state. The inner cover 4 comprises a tamper-proof seal F, wherein the tamper-proof seal F has a pulling part 16.

Figure 26:
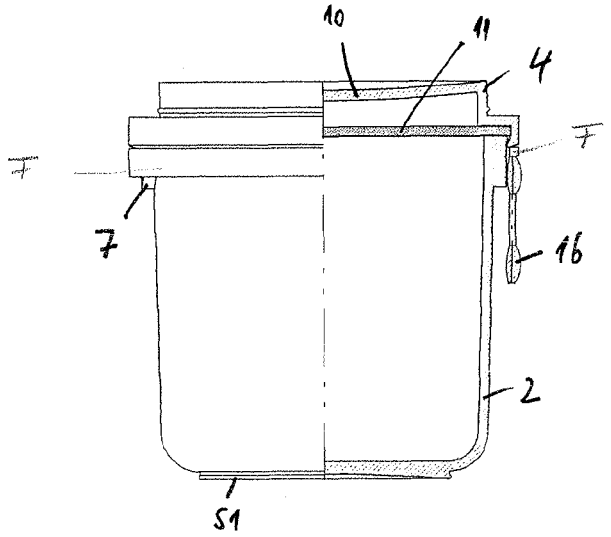
FIG. 26 shows a side view and section through the inner container and the inner cover in the connected state.

FIG. 26 shows on the left-hand side a side view and on the right-hand side a section through the inner container 2 and the inner cover 4 in the connected state. A disk S1 projects like a plateau from the bottom side of the inner container 2. At the side of the inner container 2 which is in contact with the inner cover 4, the wall of the inner container 2 comprises at the outer side a projection 7. The inner cover 4 comprises an inner insert 11 and a cap 10. The cap 10 comprises a tamper-proof seal F which in turn has a pulling part 16. The sectional view is selected such that the section extends through the pulling part 16.

Figure 27:
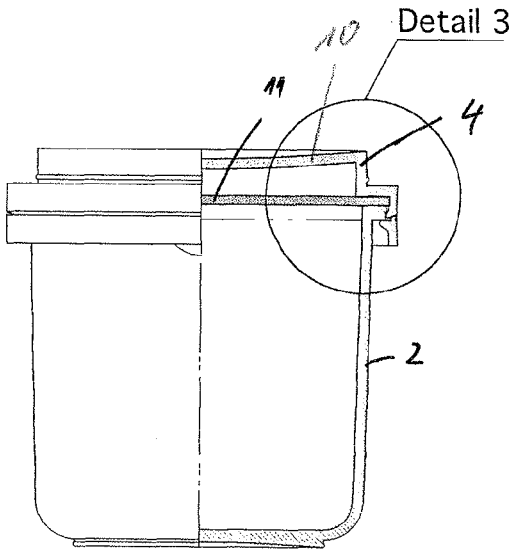
FIG. 27 shows a partial section through the inner container and the inner cover in the connected state.

FIG. 27 shows on the left-hand side a side view and on the right-hand side a section through the inner container 2 and the inner cover 4 in the connected state. The inner cover 4 comprises an inner insert 11 and a cap 10. The connection between inner cover and inner container is shown here in an alternative preferred embodiment.

Figure 28:
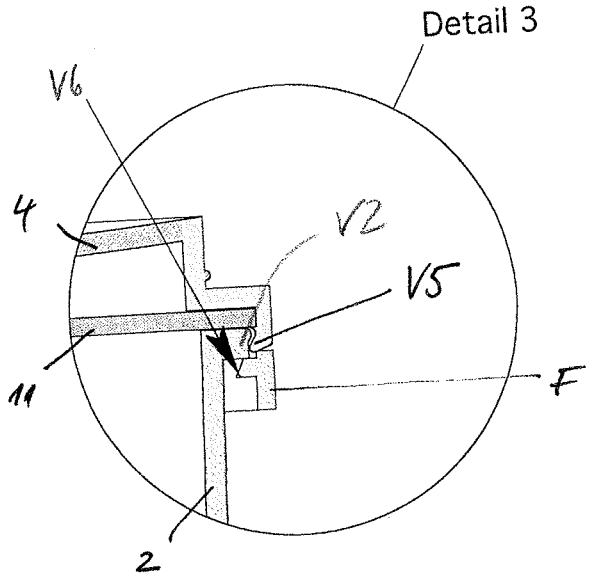
FIG. 28 shows a detail of FIG. 27.

FIG. 28 shows a detail of FIG. 27 which shows the connection between the inner container 2 and the inner cover 4 particularly clearly. An inner insert 11, which forms the direct cover of the inner container 2, is inserted into the inner cover 4. The inner cover 4 moreover comprises an inwardly-directed projection V5. This projection V5 of the inner cover 4 can in turn lock with an outwardly-directed projection V2 of the inner container 2 being provided at the opening side of the inner container 2. Moreover, the inner cover 4 comprises a tamper-proof seal F. The tamper-proof seal F comprises an inwardly-directed projection V6, wherein this projection V6 is moved below the outwardly-directed projection V2 of the inner container 2. Thus, the tamper-proof seal F provides for an additional connection between the inner cover 4 and the inner container 2, wherein this connection must be released before the inner cover 4 can be disconnected from the inner container 2.

Although the invention has been shown and described in detail on the basis of the Figures and the corresponding description, these illustrations and this detailed description should be understood to be illustrative and exemplary and not as limiting the invention. It is clear that experts can make changes and modifications without leaving the scope of the following claims. In particular, the invention also comprises embodiments with any combination of features that have been mentioned or shown above in connection with various aspects and/or embodiments.

The invention claimed is:

1. A container system comprising four components configured to be assembled to form a container, the container system comprising:

an outer container configured to receive an inner container from a first side, and be connected with the inner container by means of a first fixing mechanism, wherein, at a second side which is opposite to the first side, the outer container comprises an opening into which a bottom section of the inner container is to be inserted;

the inner container configured to be inserted into the outer container, and be connected with the outer container by means of the first fixing mechanism, wherein the inner container comprises an opening configured to be closed by means of an inner cover, and be connected with the inner cover by means of a second fixing mechanism;

an outer cover configured to receive the inner cover and be connected with the inner cover by means of a third fixing mechanism, wherein the outer cover comprises an opening into which a section of the inner cover is to be inserted, and wherein the outer cover is further configured to be releasably connected by means of a fourth fixing mechanism with the outer container; and the inner cover configured to be inserted into the outer cover, and be connected with the outer cover by means of the third fixing mechanism;

wherein the first fixing mechanism comprises a first snap-in connection realized such that a first edge formed by a rim of the opening of the outer container is configured to be locked with an at least partially circumferential first groove at a bottom side of the inner container, wherein the bottom side is opposite to an opening side of the inner container, and wherein the first edge is locked in the first groove by a single, relative axial movement of the inner and outer containers toward each other along an axis of the outer container and without a relative rotational movement of the inner and outer containers about the axis, wherein the second fixing mechanism comprises a third snap-in connection realized such that (a) the inner cover is configured to snap in the inner container and (b) first projections provided at an outer side of the opening of the inner container comprise circumferential second grooves configured to be locked with second projections located at an inner side of the inner cover, wherein the third fixing mechanism comprises a second snap-in connection realized such that a rim of the opening in the outer cover is provided with inwardly-directed third projections configured to be locked with an at least partially circumferential third groove at an upper side of the inner cover, and wherein the third projections are locked in the third groove by a single, relative axial movement of the inner and outer covers toward each other along the axis of the outer container and without a relative rotational movement of the inner and outer covers about the axis, wherein the upper side of the inner cover is opposite to a lower side of the inner cover, and the lower side of the inner cover is opposite to the opening of the inner container when the inner container is closed by means of the inner cover, and wherein the third fixing mechanism is configured to provide a stronger connection than the second fixing mechanism, and the first fixing mechanism is configured to provide a stronger connection than the second fixing mechanism.

2. The container system according to claim 1, wherein the bottom section of the inner container projects like a plateau from the bottom side of the inner container, and has an at least partially circumferential fourth projection, and the at least partially circumferential first groove is formed between the fourth projection and an area of a wall of the inner container which directly adjoins the bottom section.

3. The container system according to claim 1, wherein the fourth fixing mechanism comprises a screw connection.

4. The container system according to claim 1, wherein the section of the inner cover projects like a plateau from the upper side of the inner cover and has an at least partially circumferential fifth projection, and the at least partially circumferential third groove is formed between the fifth projection and an area of the upper side of the inner cover directly adjoining the section.

5. The container system according to claim 1, wherein the outer cover comprises a recess around the opening of the outer cover so that an inner wall of the opening of the outer cover retreats elastically when the inner cover is locked.

6. The container system according to claim 1, wherein the outer side of the inner container comprises at least one projection projecting against rotation of the inner container, and the outer container comprises at least one corresponding recess for each of the at least one projection of the inner container, so that when the inner container is inserted into the outer container, each of the at least one projection is configured to be inserted into the corresponding recess in an inner side of the outer container, or after insertion of the inner container into the outer container, each of the at least one projection is configured to be located in the corresponding recess in the inner side of the outer container.

7. The container system according to claim 1, wherein the first projections provided at the outer side of the opening of the inner container are selected from the group consisting of an at least partially circumferential edge, projecting knobs and segments, the second projections are selected from the group consisting of an at least partially circumferential edge, projecting knobs and segments, and the inwardly-directed third projections are selected from the group consisting of an at least partially circumferential second edge, projecting knobs and segments.

8. A container system, comprising: an outer container, an outer cover, an inner container and an inner cover, wherein the inner container is insertable into the outer container from a first side, and at a second side which is opposite to the first side, the outer container comprises an opening into which a bottom section of the inner container is to be inserted, wherein the outer container is configured to be releasably connected with the inner container by means of a first fixing mechanism, and the inner container is configured to be releasably connected with the inner cover by means of a second fixing mechanism, and the inner cover is configured to be inserted into the outer cover from a third side, wherein the outer cover, at a fourth side which is opposite to the third side, comprises an opening into which a section of the inner cover is to be inserted, wherein the outer cover is configured to be releasably connected with the inner cover by means of a third fixing mechanism, and the outer cover is configured to be releasably connected with the outer container by means of a fourth fixing mechanism, wherein the first fixing mechanism comprises a first snap-in connection realized such that a first edge formed of a rim of the opening of the outer container is configured to be locked with an at least partially circumferential first groove at a lower side of the inner container which is opposite to an opening side of the inner container, and wherein the first edge is locked in the first groove by a single, relative axial movement of the inner and outer containers toward each other along an axis of the outer container and without a relative rotational movement of the inner and outer containers about the axis, wherein the second fixing mechanism comprises a third snap-in connection realized such that (a) the inner cover is configured to be put on the inner container and (b) an at least partially circumferential, outwardly directed first projection provided at the opening side of the inner container comprises an at least partially circumferential second groove configured to be locked with second projections provided at an inner side of the inner cover, wherein the third fixing mechanism comprises a second snap-in connection realized such that a rim of the opening provided in the outer cover comprises third projections configured to be locked with an at least partially circumferential third groove at the inner cover, and wherein the third projections are locked in the third groove by a single, relative axial movement of the inner and outer covers toward each other along the axis of the outer container and without a relative rotational movement of the inner and outer covers about the axis, and wherein the third fixing mechanism is configured to provide a stronger connection than the second fixing mechanism, and the first fixing mechanism is configured to provide a stronger connection than the second fixing mechanism.

9. The container system according to claim 8, wherein the first groove is realized by a circumferential fourth projection provided at the lower side of the inner container.

10. The container system according to claim 8, wherein the fourth fixing mechanism comprises a screw connection.

11. The container system according to claim 8, wherein a recess is provided in the outer cover around the opening of the outer cover so that the rim of the opening of the outer cover retreats elastically when the inner cover is locked.

12. The container system according to claim 8, wherein the third groove is realized by at least one circumferential fourth projection provided at the inner cover.

13. The container system according to claim 8, wherein the second projections provided at the inner side of the inner cover are selected from the group consisting of an at least partially circumferential edge, projecting knobs or segments, and the third projections of the rim of the opening provided in the outer cover are selected from the group consisting of an at least partially circumferential edge, projecting knobs and segments.

14. A container system, comprising an outer container and an outer cover, the outer container comprising:

a first fixing mechanism for releasably connecting the outer container with an inner container after having received the inner container, and an opening configured to be closed by means of the outer cover, wherein the outer container is configured to be releasably connected with the outer cover at a side of the opening by means of a fourth fixing mechanism; and the outer cover comprising:

an opening for receiving an inner cover, and a third fixing mechanism for releasably connecting the outer cover with the inner cover after having received the inner cover, wherein the first fixing mechanism comprises a first snap-in connection realized such that first projections of the outer container are configured to be locked with an at least partially circumferential first groove at a side of the inner container being opposite to an opening of the inner container, and wherein the first projections are locked in the first groove by a single, relative axial movement of the inner and outer containers toward each other along an axis of the outer container and without a relative rotational movement of the inner and outer containers about the axis; and wherein the third fixing mechanism comprises a second snap-in connection realized such that second projections of the outer cover are configured to be locked with an at least partially circumferential second groove at a side of the opening of the inner cover and wherein the second projections are locked in the second groove by a single, relative axial movement of the inner and outer covers toward each other along the axis of the outer container and without a relative rotational movement of the inner and outer covers about the axis.

15. The container system according to claim 14, wherein the first projections of the first snap-in connection are selected from the group consisting of an at least partially circumferential first edge, projecting knobs and segments.

16. The container system according to claim 14, wherein the second projections of the second snap-in connection are selected from the group consisting of an at least partially circumferential second edge, projecting knobs and segments.

17. The container system according to claim 14, wherein the fourth fixing mechanism comprises a screw connection.

18. The container system according to claim 14, wherein the first groove is realized by an at least partially circumferential third projection provided at the side of the inner container which is opposite to the opening of the inner container, and the second groove is realized by an at least partially circumferential fourth projection provided at the side of the opening of the inner cover.

* * * * *